US007878727B2

(12) United States Patent
Koptis

(10) Patent No.: US 7,878,727 B2
(45) Date of Patent: Feb. 1, 2011

(54) DISPENSER CAP AND DISPENSER

(76) Inventor: Kurt Koptis, 57494 Bandera Rd., Yucca Valley, CA (US) 92284

( * ) Notice: Subject to any disclaimer, the term of this patent is extended or adjusted under 35 U.S.C. 154(b) by 1195 days.

(21) Appl. No.: 11/408,266

(22) Filed: Apr. 20, 2006

(65) Prior Publication Data

US 2007/0201941 A1 Aug. 30, 2007

Related U.S. Application Data

(60) Provisional application No. 60/777,177, filed on Feb. 27, 2006.

(51) Int. Cl.
*A46B 11/00* (2006.01)

(52) U.S. Cl. ..... 401/126; 401/123; 401/270; 401/290

(58) Field of Classification Search ..... 401/118, 401/123, 126, 270, 290; 15/205.2, 176.1, 15/176.2, 84
See application file for complete search history.

(56) References Cited

U.S. PATENT DOCUMENTS

| | | | | |
|---|---|---|---|---|
| 1,042,032 | A | 10/1912 | Pederson | |
| 1,725,464 | A | 8/1929 | Lysons | |
| 1,846,711 | A | 2/1932 | Evanson | |
| 2,104,470 | A | 1/1938 | Roland | |
| 2,257,606 | A | 9/1941 | Herbert | |
| D188,397 | S | 7/1960 | Hulsh | |
| 2,962,743 | A | 12/1960 | Henriksson | |
| 3,016,561 | A | 1/1962 | Hulsh | |
| 3,072,953 | A | 1/1963 | Bunke | |
| 3,121,906 | A | 2/1964 | Hulsh | |
| 3,486,666 | A | 12/1969 | Herzig et al | |
| 3,719,460 | A | 3/1973 | Brockman | |
| 3,756,732 | A | 9/1973 | Stofler | |
| 4,089,609 | A | 5/1978 | Gring et al. | |
| 4,726,386 | A | 2/1988 | Schultz | |
| 4,748,990 | A | 6/1988 | Brown et al. | |
| 4,762,433 | A | 8/1988 | Bergeson et al. | |
| 4,964,548 | A | 10/1990 | Kenyon, Jr. | |
| 5,184,909 | A | 2/1993 | Schaefer | |
| D346,959 | S | 5/1994 | Adams | |
| D351,338 | S | 10/1994 | Koptis | |
| 5,577,851 | A | 11/1996 | Koptis | |
| D376,048 | S | 12/1996 | Gerhart et al. | |
| 5,971,645 | A * | 10/1999 | Fukushima et al. | 401/183 |
| 5,988,923 | A | 11/1999 | Arai | |
| 6,036,389 | A * | 3/2000 | Zima | 401/137 |
| 6,053,184 | A | 4/2000 | Devone | |
| 6,086,278 | A | 7/2000 | Keller | |
| 6,123,477 | A | 9/2000 | Hecker | |
| 6,457,894 | B1 * | 10/2002 | Miles | 401/282 |
| D481,166 | S | 10/2003 | Angeletta | |
| D487,637 | S | 3/2004 | Price | |
| 2001/0016962 | A1 | 8/2001 | Moore et al. | |

OTHER PUBLICATIONS

PCT/US2004,35364, Nov. 2005, Platinum Innovations, Inc, Written Opinion and Search Report.

* cited by examiner

*Primary Examiner*—David J Walczak
(74) *Attorney, Agent, or Firm*—John J. Connors; Connors & Assoc.

(57) ABSTRACT

A dispenser cap is threaded onto a container that may hold liquids of varying viscosity. The dispenser cap has a cover that can be flipped open and closed. Integral with this cover is a plurality of bristles that can be used to scrub various surfaces.

3 Claims, 11 Drawing Sheets

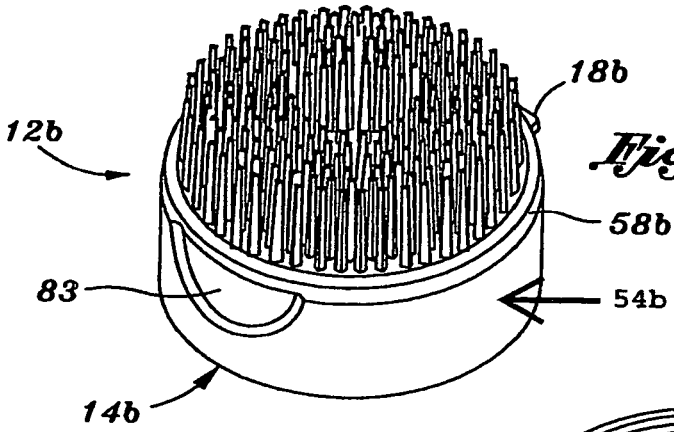
Fig. 9
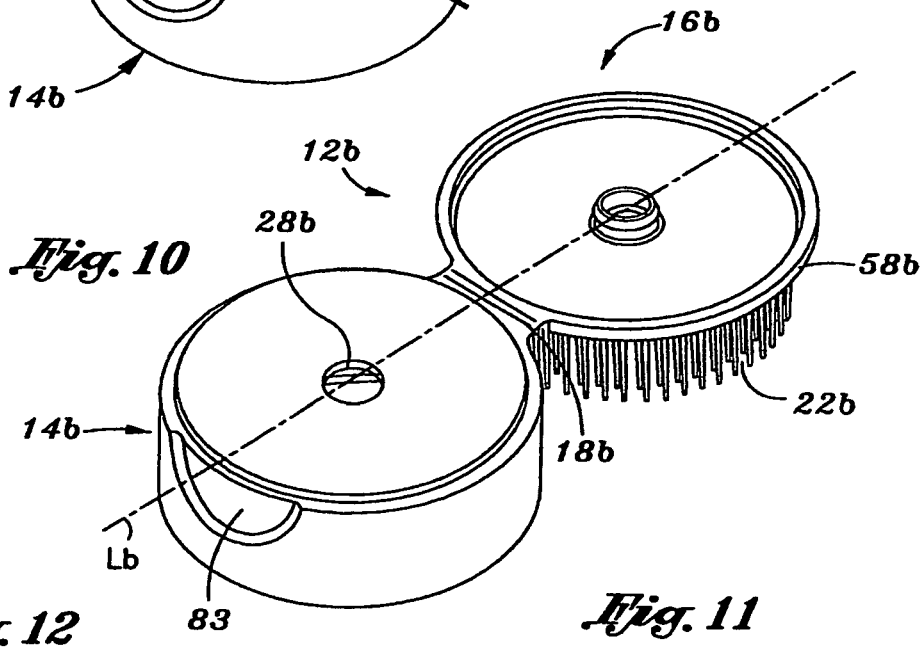
Fig. 10
Fig. 12
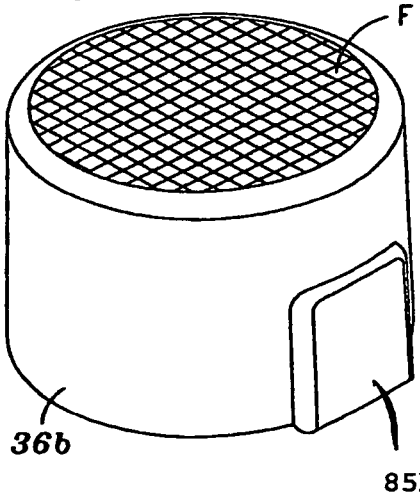
Fig. 11
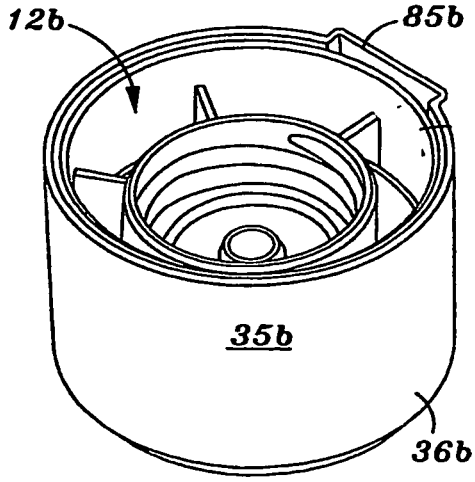

DISPENSER CAP AND DISPENSER

RELATED PATENT APPLICATIONS & INCORPORATION BY REFERENCE

This a continuation-in-part application which claims the benefit under 35 USC 119(e) of Ser. No. 60/777,177, filed Feb. 27, 2006, entitled "DISPENSER CAP & DISPENSER," and is also the national stage of International Application No. PCT/US2004/035364, which claims the benefit under 35 USC 119(e) of Ser. No. 60/513,386, entitled "Flip Brush Applicator Tube and Bottle Closure Molded As One Unit," filed Oct. 23, 2003. Embodiments of the invention were disclosed to the United States Patent and Trademark Office in Disclosure Document No. 538056 deposited on Sep. 8, 2003, and in Disclosure Document No. 542309 deposited on Nov. 26, 2003. These related International and provisional applications and disclosure documents are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

BACKGROUND OF INVENTION

Many types of products come in a container with a common cap that serves only to keep the contents of the container sealed within the container. This is good for preserving the contents of the container but has no additional use outside of this limited purpose. There are also some containers that have caps with bristles protruding from the top, surrounding a hole through which contents of the container can escape. While this type of cap is more functional than a common cap, the fact that there is a hole in it means that the contents of the container will leak out as the user is using the bristles, which in some situations may be desirable. This invention improves on the functionality of both the common cap and bristled cap.

SUMMARY OF INVENTION

This invention has one or more features as discussed subsequently herein. After reading the following section entitled "DETAILED DESCRIPTION OF SOME EMBODIMENTS OF THIS INVENTION," one will understand how the features of this invention provide its benefits. The benefits of this invention include, but are not limited to: (a) allowing the user to scrub various items using the bristles attached to a container cap, (b) providing a container that has more functionality than a standard container by not only providing a device for storing a product but also includes an attached scrubber, (c) providing a container that has a cap with bristles attached to it that does not leak while the user is scrubbing, (d) providing a container that has a cap with bristles attached to it that can be washed while still attached to the container without liquid entering the container and contaminating its contents, (e) providing a top enclosure for the container cap that includes an abrasive surface for filing or other purposes and prevents or inhibits accidental spillage of the contents of the container, and (f) providing a detachable top enclosure including an internal pin that helps keep the dispenser sealed.

This invention employs a dispenser cap including a cover member and a base member attached together by a hinge element and moveable between open and closed positions. Bristle elements on the cover member are used to scrub a surface when the cap is closed. In one version only the base member has an opening therein. In another version both the cover and base members have openings therein and a detachable top enclosure with an internal pin seals the opening in the cover member when the cap is closed.

Without limiting the scope of this invention as expressed by the claims that follow, some, but not necessarily all, of its features are:

One, the hinge element enables the base member and cover member to move between a first position where the cover member covers the base member and a second position where the cover member uncovers the base member. The cover member has an exterior surface with a plurality of the bristle elements projecting outward therefrom and an interior surface having a sealing member thereon that seals the opening when the cover member and base member are in the first position. The bristle elements typically have a length from about ¼ to about 1 and ½ inch. The sealing member allows the user to re-seal the container by simply closing the cover member once the container's contents have been applied to the surface of an item to be cleaned or otherwise treated. This prevents the contents from leaking out of the container while the user is using the attached bristles to scrub the surface of the item being cleaned or otherwise treated. Additionally, it keeps the remaining contents held within the container from drying out or alternatively removes the need for the user to keep track of a second, separate cap, to ensure that the contents do not dry out. The container may be made of a pliable material capable of being squeezed to expel its contents through an opening in the container that is aligned with the opening in the base member.

Two, the opening and sealing member may be in a male-female mating relationship when the base and cover members are in the first position. Either the base member or cover member may include a hollow cylindrical member centrally located on a top wall of the member that serves as a male component of a two component sealing mechanism. The cylindrical member has a central axis substantially perpendicular to the top wall and, when in the first position, it is aligned with the opening in the base member and it is coextensive with the central longitudinal axis of the dispenser cap. In one embodiment, the hollow cylindrical member is on the exterior of the base member top wall and provides a passageway for the contents of the container to be dispensed. In another embodiment, the hollow cylindrical member is on the interior of the cover member top wall and assists in sealing the opening in the base member.

Three, the dispenser cap may include a stop element that inhibits lateral movement of the base and cover members relative to each other when the base member and cover member are in the first position. The cap may also include a lock element that locks the base and cover members in the first position until a manually applied force separates the base and cover members. A single structure may serve both of these functions or two separate structures may be employed that each independently provides one these functions. In one embodiment, a pair of stop elements is employed. One stop element is a component of the base member and the other stop element is a component of the cover member. The stop elements engage to inhibit lateral movement of the base and cover members relative to each other when the base member and cover member are in the first position and disengages when the base member and cover member are in the second position. One stop element may comprise a ledge along a portion of a perimeter of the base member and the other stop element may comprise an edge portion of the cover member. The edge portion engages the ledge when the base member and cover member are in the first position to prevent essentially any lateral movement between the base member and cover member. This provides lateral stability so that as the user is scrubbing the cover and base members do not move relative to each other. This arrangement provides a peripheral structure at an interface between the base member and cover member that serves a dual function. With the members in the first position, this peripheral structure inhibits lateral movement of the members relative to each other and locks these members in the first position until a manually applied force separates the base and cover members. Upon mating engagement, a male sealing member inserted into the opening in the base member may also serve the dual function of locking together and inhibiting lateral movement of the base and cover members when in the first position.

Four, the bristles elements are integral with the cover member. The bristle elements may have different cross-sectional shapes, but in one embodiment at least some of the bristle elements have a triangular cross-sectional configuration. The bristle elements may be substantially parallel to each other and the central axis of the cap and they may be arranged in a plurality of concentric rings. The bristle elements are used to scrub various surfaces. By having the bristle elements attached to the cap it becomes very convenient for the user to apply the contents stored within the container and then use the very same container to scrub an item on which the contents have just been applied.

Five, the base member top wall may have an interior surface from which extends a coupling member adapted to detachably connect the cap to a container. The coupling member may comprise a cylindrical wall with an internal threaded surface that mates with treads on the container. The base member may include a cylindrical wall with an inside surface and a plurality of radial support members extending between this inside surface and an outside surface of the coupling member's cylindrical wall. By allowing the user to screw and unscrew the dispenser cap from different types of containers, the user may either refill the container as desired, or place the cap on a different container with a compatible connector element. Thus, the internal threaded surface of the coupling member allows the dispenser cap to be used more than once and under different circumstances.

Six, the base member, cover member, and hinge element are an integral, unitary structure and may be molded from the same plastic material. The cap is formed in a mold in which the base member and cover member are in the second position with the exterior surface of the base member top wall and the interior surface of the cover member top wall facing in the same general direction and being substantially aligned with the hinge element. As the cap is ejected from the mold, it may be moved into the first position with the cover member covering the base member.

Seven, the device of this invention includes a protrusion that allows the user to transition the device easily from the first closed, sealed position to the second open, unsealed position, and vice versa. Because it is a protrusion, the user is still able to make the transition easily from open to close even when their hands may be wet or slippery. The protrusion may be in the form a lip projecting outwardly from the cover member or an indentation in the base member.

Eight, the dispenser cap may additionally include a top enclosure that is detachably connected to the closed cover member and, when attached, covers the bristle elements. The top enclosure may have an exposed abrasive surface. It may also be fastened in a manner to prevent inadvertent removal. For example it may be force fitted onto the dispenser cap or alternately by shrink-wrapping or both.

Nine, both the base member and the cover member may have an opening therein, and a detachable enclosure is mounted to the cap that covers the bristle elements and at least partially blocks at least the opening in the cover member. The openings may be aligned when the cap is in a closed position. The enclosure may include an elongated pin element with a tip that at least partially blocks at least the opening in the cover member when in the closed position.

These features are not listed in any rank order nor is this list intended to be exhaustive.

DESCRIPTION OF THE DRAWINGS

Some embodiments of this invention, illustrating all its features, will now be discussed in detail. These embodiments depict the novel and non-obvious dispenser cap and dispenser of this invention as shown in the accompanying drawing, which is for illustrative purposes only. This drawing includes the following figures (FIGS.), with like numerals indicating like parts:

FIG. 9 is a perspective view of another embodiment of the dispenser cap of this invention in a completely closed position.

FIG. 10 is a perspective view of the dispenser cap shown in FIG. 9 in a completely open position.

FIG. 11 is a perspective view of the dispenser cap shown in FIG. 9 closed and lodged within a top enclosure, and inverted to show the underside of the dispenser cap.

FIG. 12 is a perspective view of the top enclosure with the dispenser cap lodged therein as depicted in FIG. 11 but inverted to show the exterior of the top enclosure.

FIG. 19 is a perspective view showing a pair of closing wheels at the right side of a mold positioned to move from the right to the left as the dispenser cap of the invention is being released from the mold.

FIG. 20 is a side view of the dispenser cap illustrated in FIG. 19 beginning to be closed by the closing wheels.

FIG. 21 is a side view of the dispenser cap shown in FIG. 20 being closed by the closing wheels as they advance from right to left.

FIG. 22 is a side view of the dispenser cap shown in FIG. 21 after the closing wheels close dispenser cap.

DETAILED DESCRIPTION OF SOME EMBODIMENTS OF THIS INVENTION

General

Figure 13:
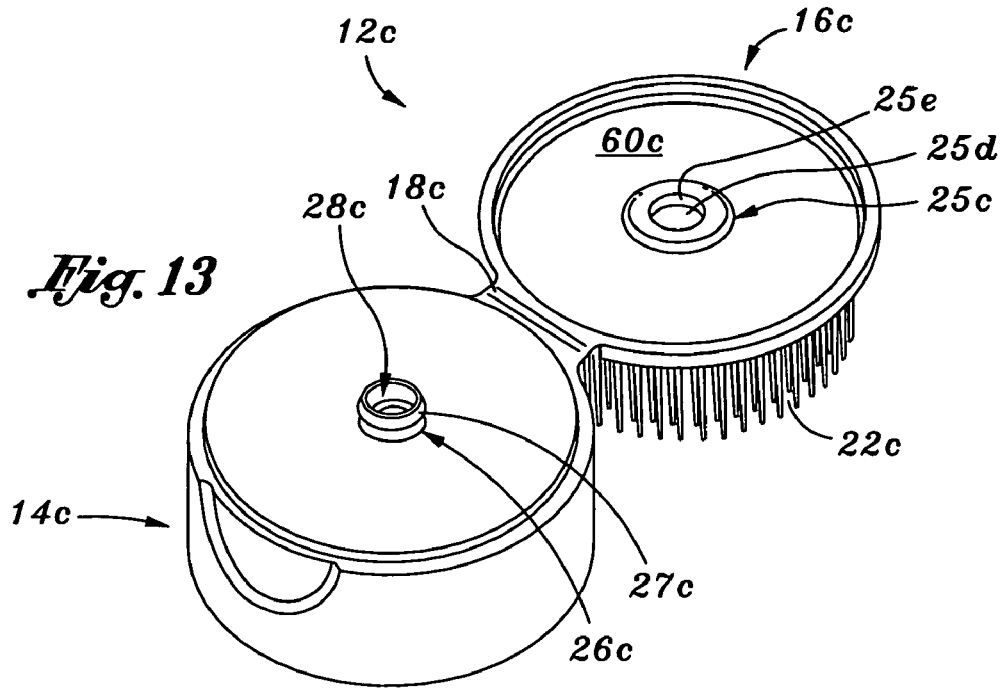
FIG. 13 is a perspective view of still another embodiment of the dispenser cap of this invention in the completely open position.
Figure 14:
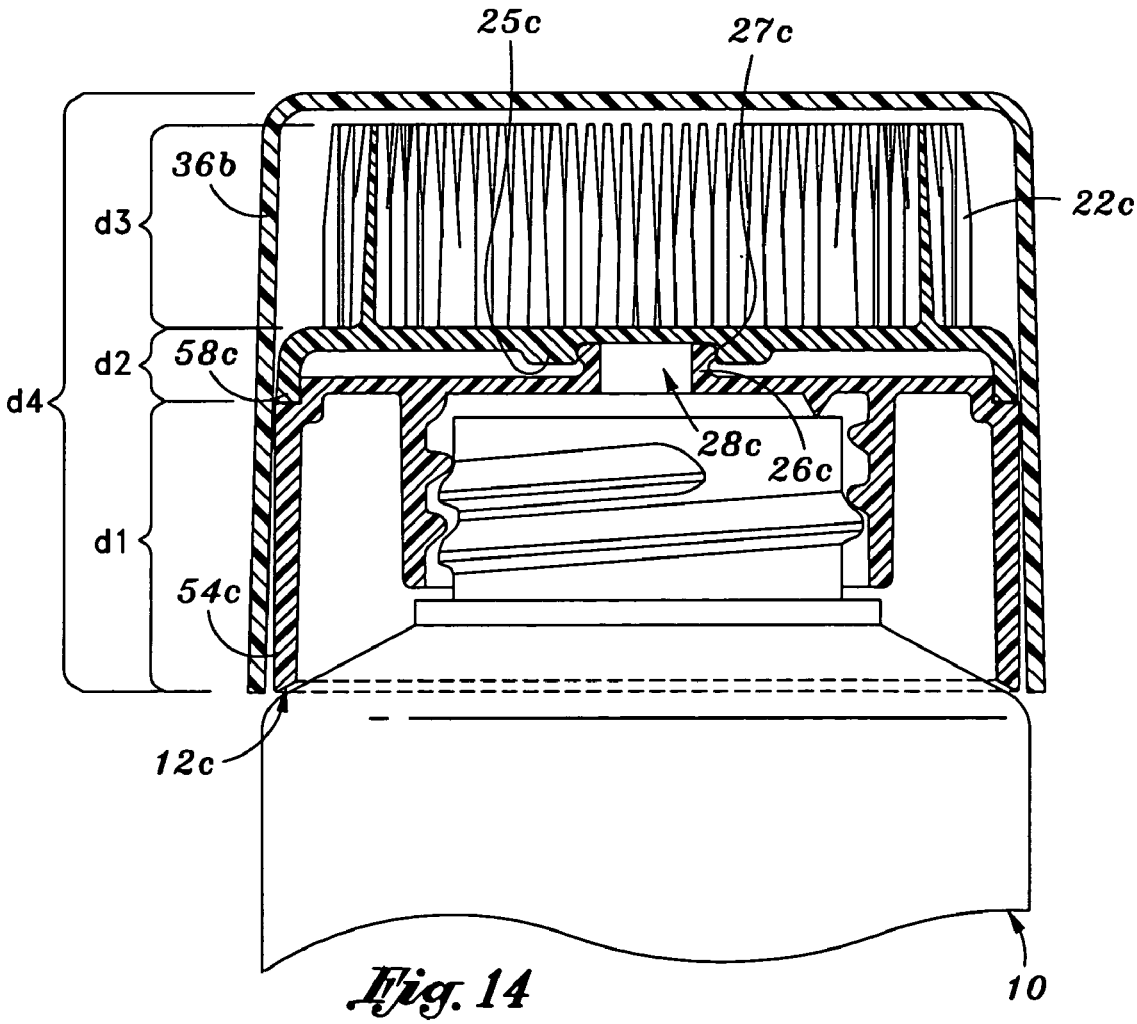
FIG. 14 is an enlarged, fragmentary cross-sectional view of the top of the container with the dispenser cap shown in FIG. 13 attached and in a completely closed position and a top enclosure attached and entirely covering dispenser cap.
Figure 15:
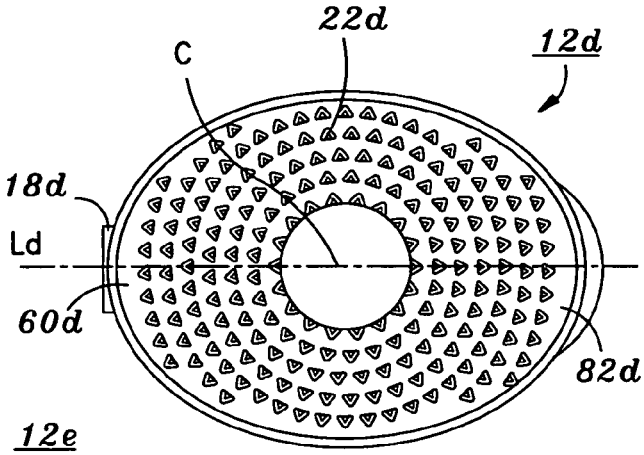
FIG. 15 is a plan view of an alternate embodiment of the dispenser cap of this invention having an oval shape.
Figure 16:
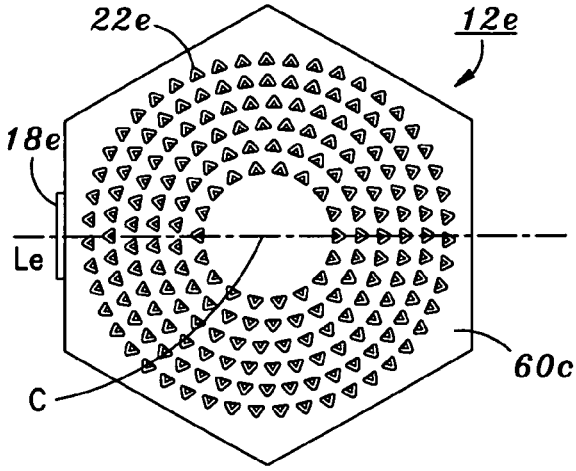
FIG. 16 is a plan view of an alternate embodiment of the dispenser cap of this invention having a hexagon shape.
Figure 17:
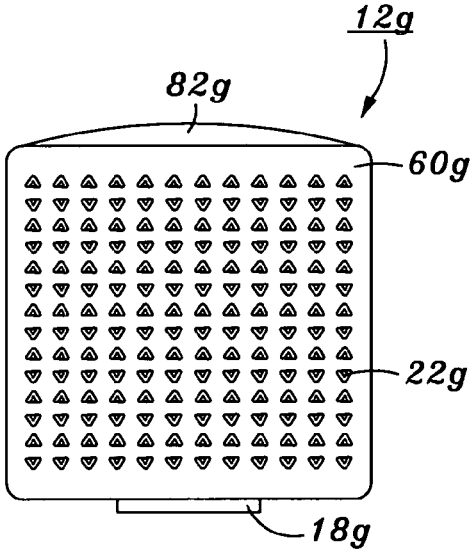
FIG. 17 is a plan view of an alternate embodiment of the dispenser cap of this invention having a square shape.
Figure 18:
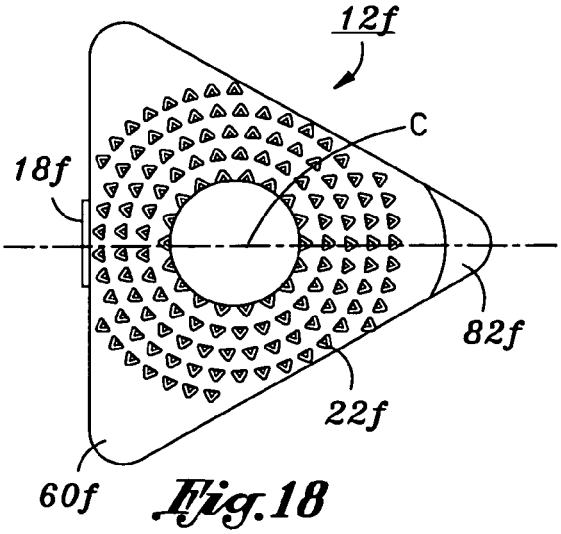
FIG. 18 is a plan view of an alternate embodiment of the dispenser cap of this invention having a triangle shape.
Figure 19:
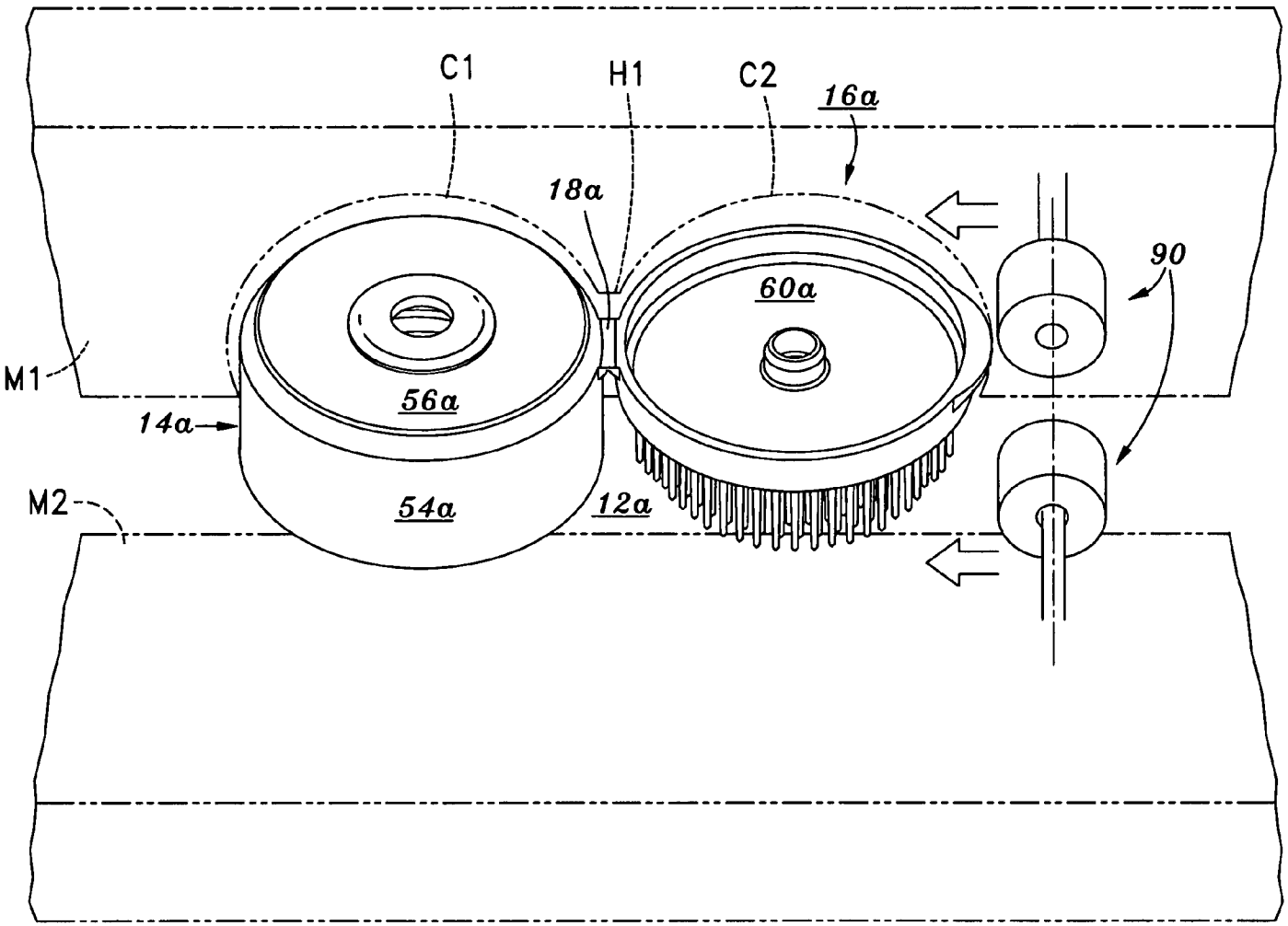
FIGS. 19 through 22 schematically depict the dispenser cap shown in FIG. 1 being released from a mold and concurrently being closed where.
Figure 20:
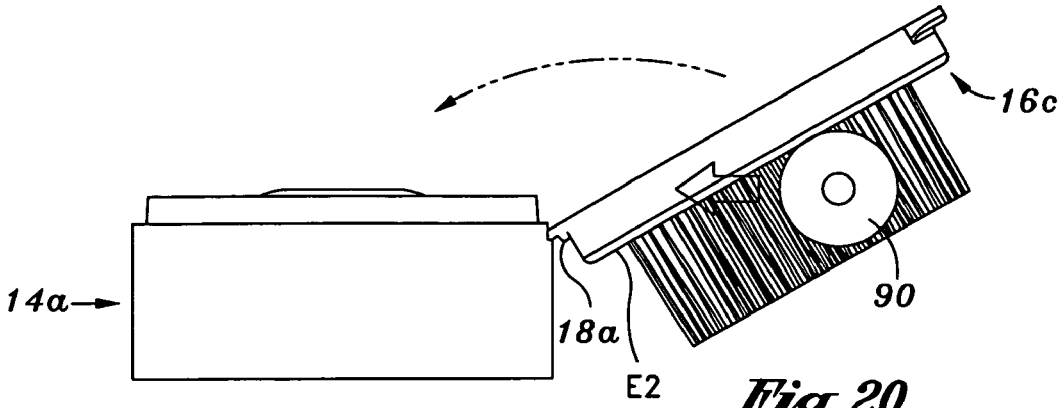
Figure 21:
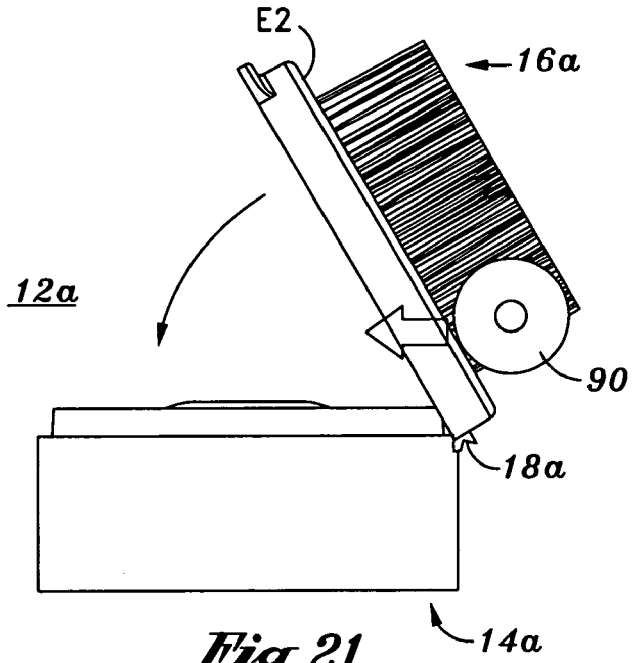
Figure 22:
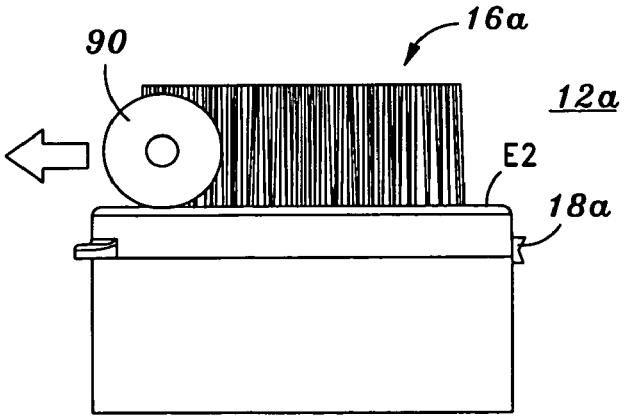

FIGS. 1 through 8 depict one embodiment of this invention, the dispenser cap 12*a* employing a male sealing member 26*a* on an interior surface 15*a* of the cap's cover member 16*a*. As discussed subsequently in greater detail, this male sealing member 26*a* snaps into place into an opening 28*a* in a base member 14*a* attached to a container 10 and surrounds an opening 9*a* (FIG. 8A) in an end of the container. FIGS. 9 through 12 depict another embodiment of this invention similar to that shown in FIGS. 1 through 8, namely, the dispenser cap 12*b* that employs an indentation 83 as a means for facilitating unlocking the connection between the cap's base and cover members. This embodiment also uses a slightly different top enclosure 36*b* than the top enclosure 36*a* used with the dispenser cap 12*a*. FIGS. 13 and 14 depict still another embodiment of this invention, the dispenser cap 12*c* employing a male sealing member 26*c* on the exterior of the cap's base member. FIGS. 15 through 18 depict different embodiments where the dispenser cap of this invention has different configurations. FIGS. 19 through 22 illustrate a pair of closing wheels 90 being used to close the dispenser cap 12*a* as it is being ejected from a mold. FIGS. 23 through 28 depict a different embodiment of the dispenser cap of this invention indicated by the numeral 100. This dispenser cap 100 has an opening 101 extending through a cover member 116 that when closed covers a base member 114. The cover member 116 and base member 114 are essentially identical to the base member 16*a* and 14*a*, respectively, except for the opening 101. The dispenser cap 100 is interactive with a top enclosure 136 having an elongated pin element 102 that is inserted into the opening 101 when the cover member 116 is closed and the enclosure is placed thereon.

The different embodiments of this invention may all be molded from a plastic material such as, for example, polypropylene or any other suitable plastic composition.

FIGS. 1 Through 8

Figure 7:
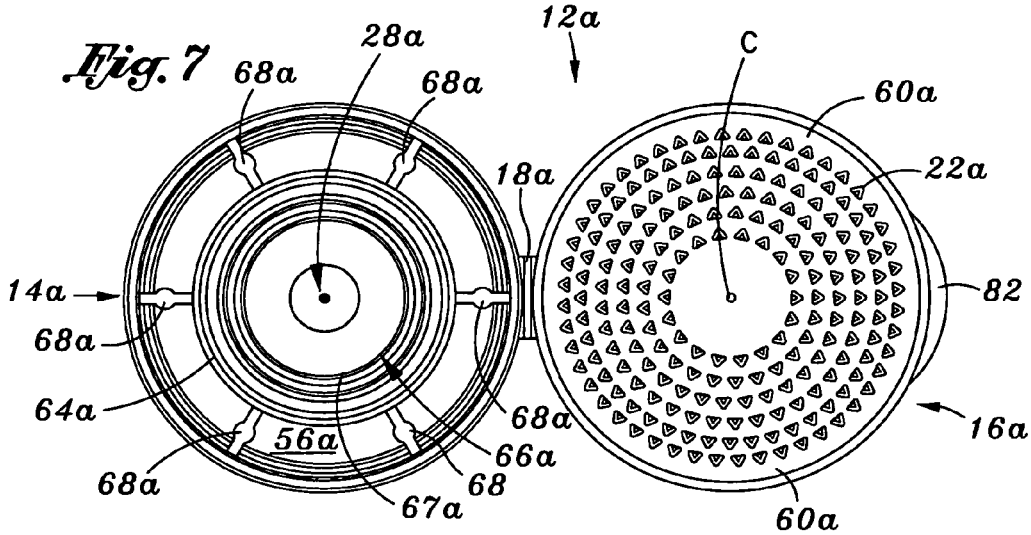
FIG. 7 is a plan view of the dispenser cap shown in FIG. 1 in a completely open position showing the interior surface of the top wall of the base member and the exterior surface of the top wall of the cover member.
Figure 8:
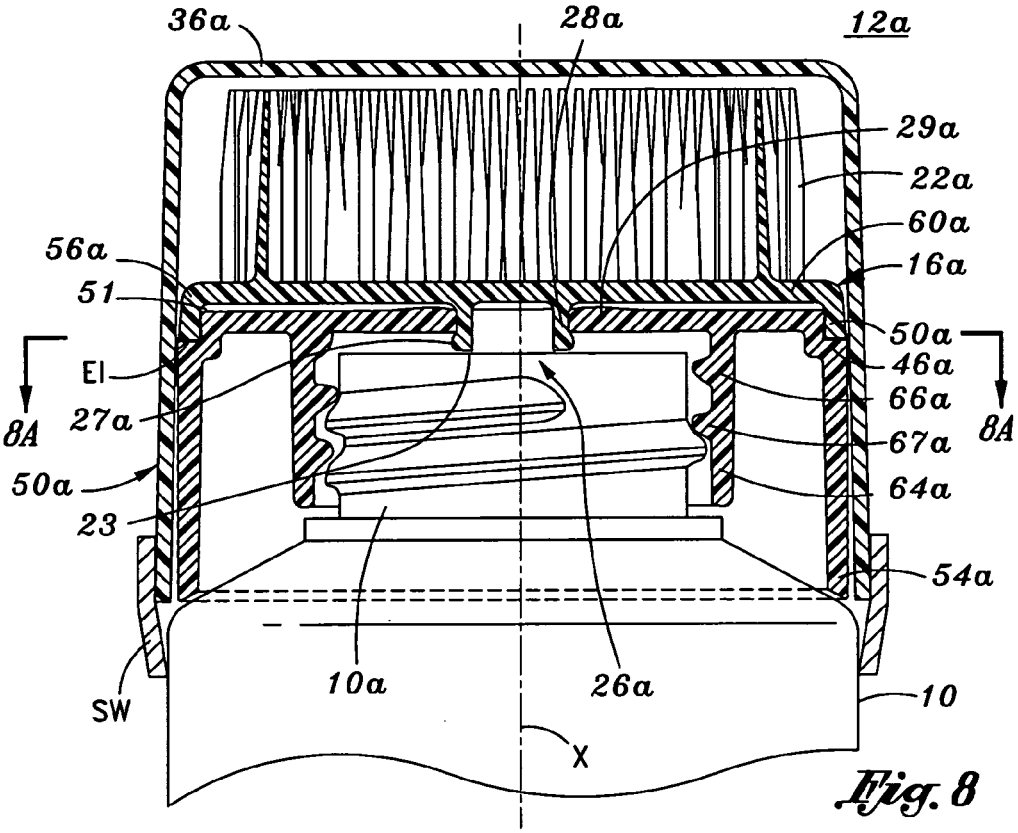
FIG. 8 is an enlarged, fragmentary cross-sectional view of the top of the container with the dispenser cap shown in FIG. 1 attached and in a completely closed position and the top enclosure attached and entirely covering dispenser cap.

As shown in FIGS. 1 through 8, the dispenser cap 12*a* comprises a base member 14*a* attached to a cover member 16*a* by a "living" hinge 18*a*. A plurality of bristles 22*a* protrudes from the top of the cover member 16*a*. The dispenser cap 12*a* is a single, integral, unitary structure comprising the cover member 16*a* and attached bristles 22*a*, the base member 14*a*, and the hinge 18*a*. As shown in FIG. 8, the dispenser cap 12*a* may be attached to a container 10 by mating an internal threaded surface 66*a* (FIG. 4) located within the base member 14*a* to a matching threaded container neck 10*a* having a central, small diameter opening 9*a* (FIG. 8A) at one end thereof. With the cap 12*a* in the closed position and connected to the container as shown in FIG. 8, the central longitudinal axis X of the cap is aligned with and extends through the centers of the opening 9*a*, the opening 28*a*, and the male sealing member 26*a*. The axes of the opening 28*a* and the male sealing member 26*a* are coextensive with the axis X. Besides having the opening 9*a* through which the contents of the container 10 is dispensed, the container typically is a bottle or tube type structure capable of holding substances typically ranging in viscosity from liquid to gel-like. The container 10 typically is made of a non-rigid, pliable material so the user may simply squeeze the container 10 to expel its contents.

Figure 1:
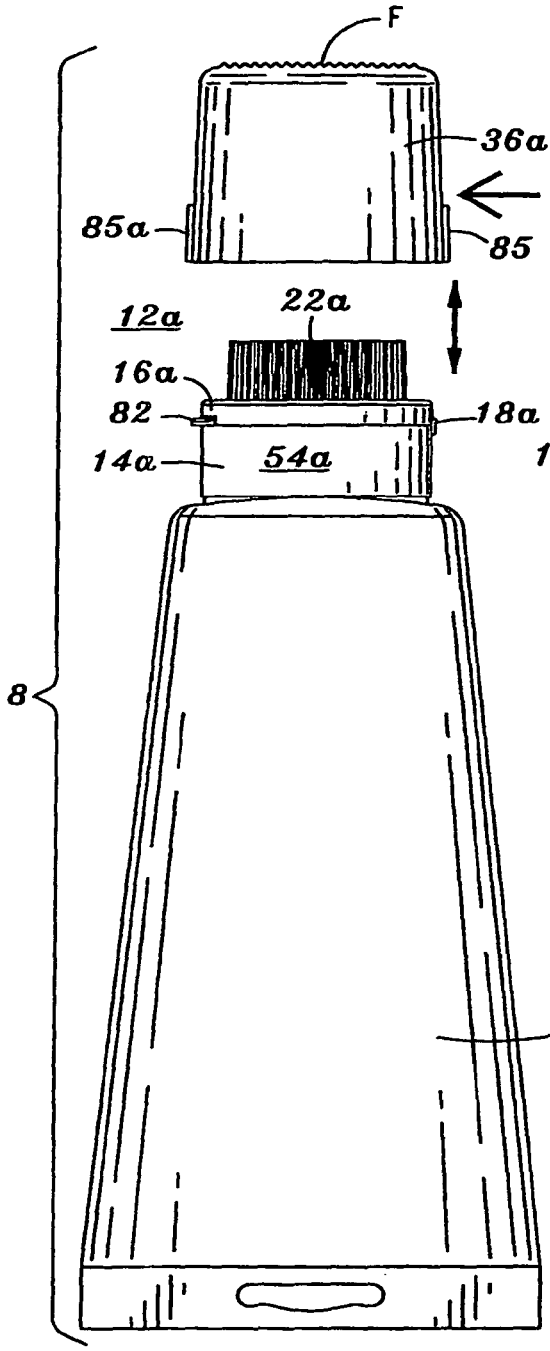
FIG. 1 is a side elevational view of a container with one embodiment of the dispenser cap of this invention detachably connected thereto and in a closed position with a top enclosure detached.
Figure 2:
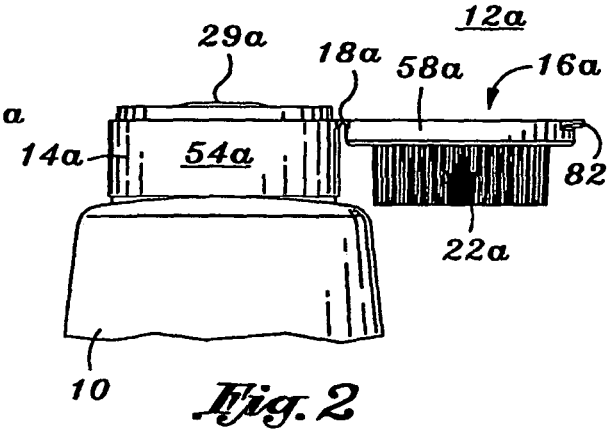
FIG. 2 is a fragmentary side view of the top portion of the container shown in FIG. 1 with the dispenser cap in a completely open position.

FIG. 1 shows the dispenser cap 12*a* in the closed position with its associated detachable top enclosure 36*a* removed so the cover member 16*a* may be moved into an open dispensing position. FIG. 2 shows the dispenser cap 12*a* in the opened position ready to dispense the contents of the container 10. The top enclosure 36*a* may be made of a transparent material, for example, so that the bristles 22*a* may be seen when the top enclosure is in place as shown in FIG. 8. A top enclosure is a desirable feature enabling the bristles 22*a* to be covered and protected when not in use. A top enclosure may be included with all the different embodiments depicted herein, and is modified as required for each different embodiment.

When the dispenser cap 12*a* is in the closed position (FIG. 1) and the top enclosure 36*a* is detached, the user can use the attached bristles 22*a* to scrub whatever item needs to be scrubbed without having the contents within the container 10 leaking out through the opening 28*a* or opening 9*a*. Moreover, the base member 14*a* and cover member 16*a* are designed so that lateral movement between these members is substantially eliminated during use of the bristles 22*a* with the cap 12*a* in the closed position. In this, as well as the other embodiments, the cap 12*a* is locked in the closed position to further insure that leakage is avoided during use.

Figure 3:
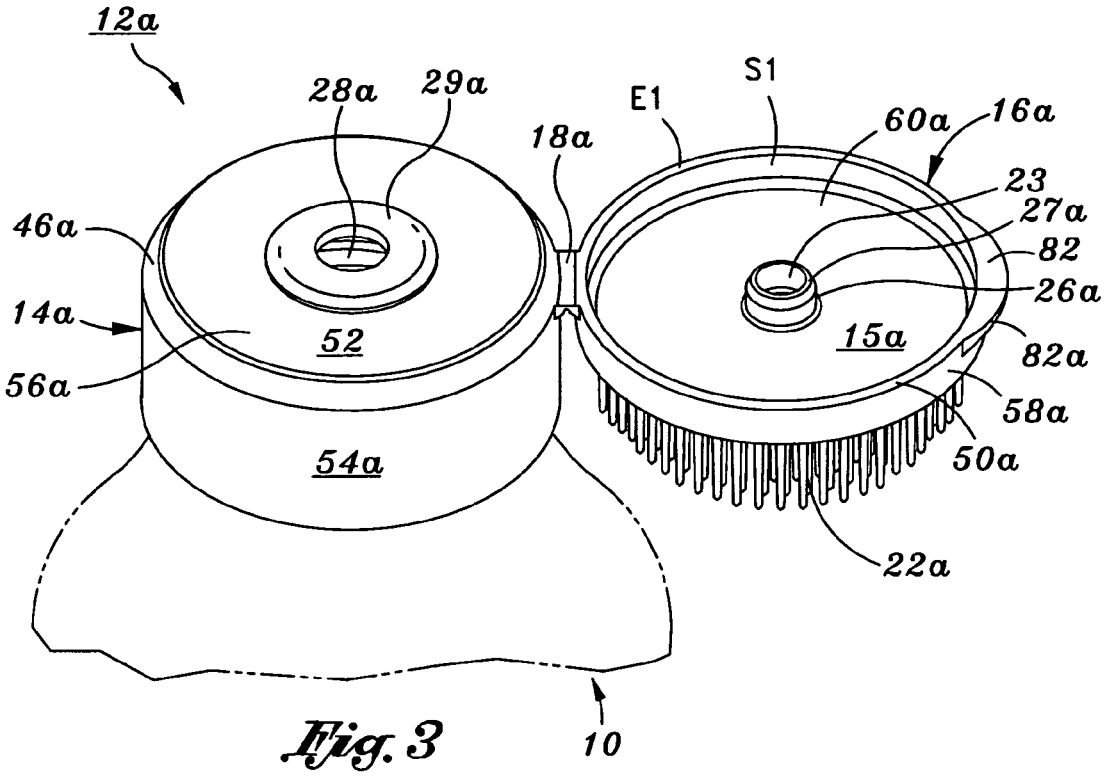
FIG. 3 is a fragmentary perspective view of the top of the container with the attached dispenser cap shown in FIG. 1 in a completely open position.
Figure 4:
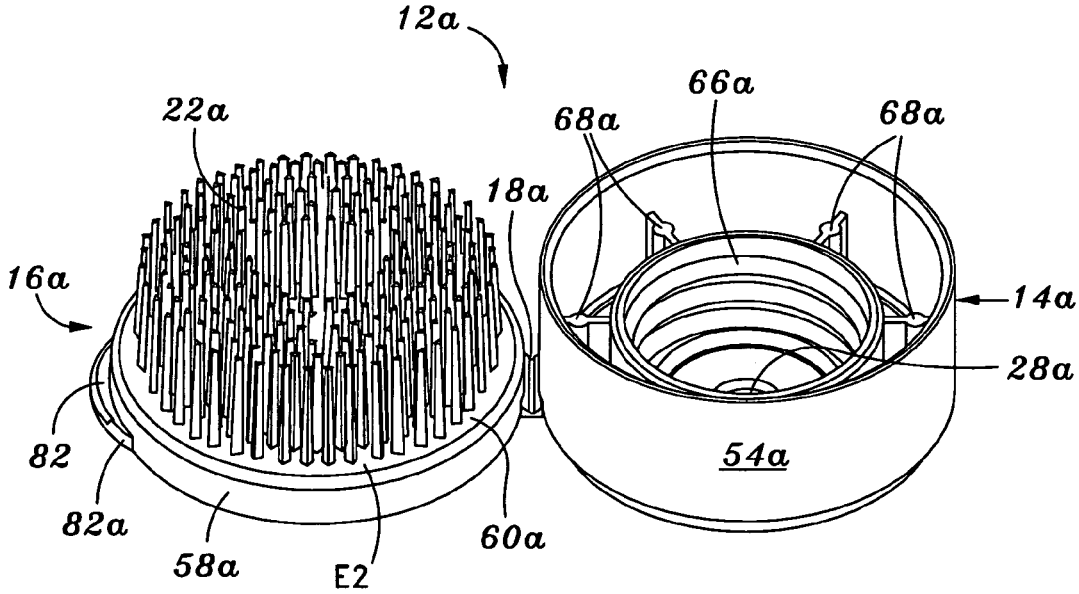
FIG. 4 is a perspective view of the dispenser cap shown in FIG. 1 in a completely open position showing the underside of the base member and topside of the cover member.
Figure 5:
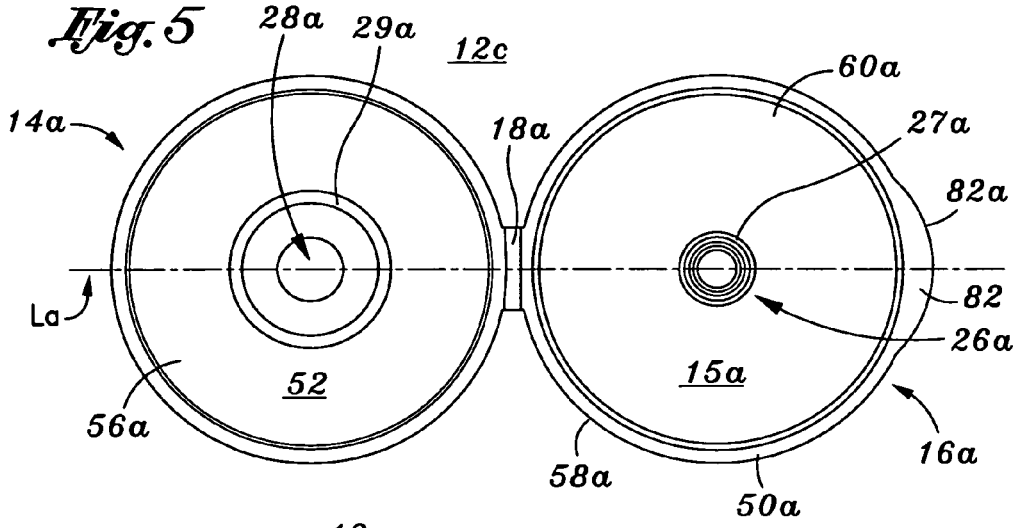
FIG. 5 is a plan view of the dispenser cap shown in FIG. 1 in a completely open position showing the exterior surface of the top wall of the base member and the interior surface of the top wall of the cover member.
Figure 6:
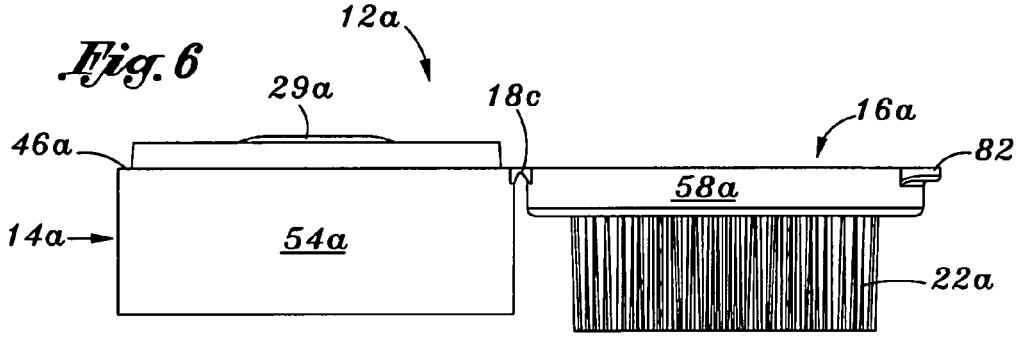
FIG. 6 is a side view of the dispenser cap shown in FIG. 5 with the dispenser cap in a completely open position.
Figure 8A:
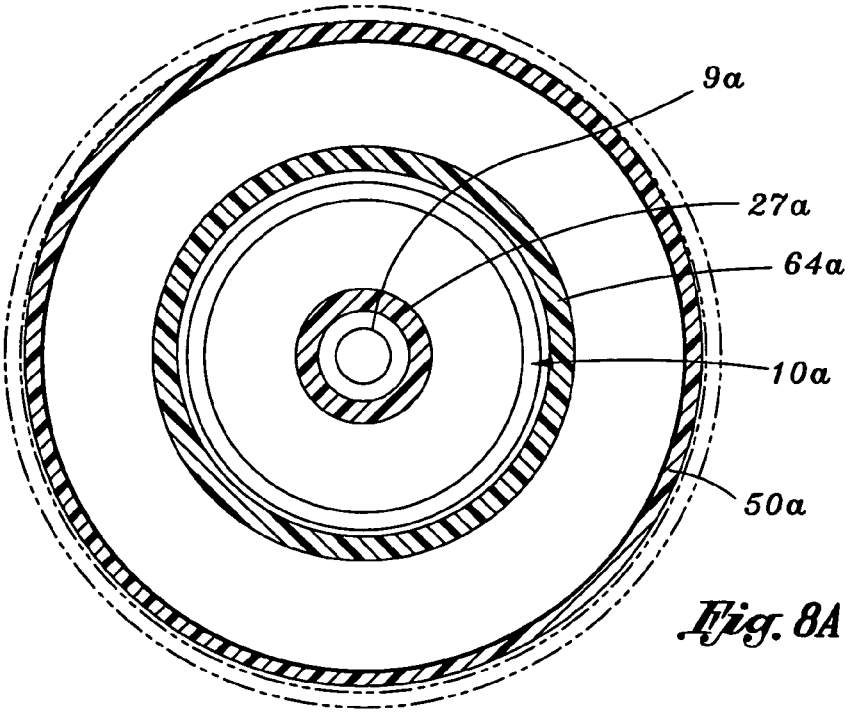
FIG. 8A is a cross-sectional view taken along line 8A-8A of FIG. 8.

As best shown in FIGS. 3 through 5, the cover member 16*a* and base member 14*a* are each cylindrical shaped with approximately the same outside diameters. The cover member 16*a* has a circular shaped top wall 60*a* that is at a right angle to a sidewall 58*a*. A male sealing member 26*a* is centrally located on an interior surface 15*a* of the cover member 16*a*. The male sealing member 26*a* is a hollow cylinder extending outward at a right angle from the interior surface 15*a*. As best illustrated in FIGS. 8A, and 8, the outside diameter of the male sealing member 26*a* is substantially equal to the diameter of the opening 28*a* and its inside diameter is greater than the diameter of the opening 9*a*. At an open end 23 of the hollow cylindrical male sealing member 26*a* furthest away from the cover member 16*a*, the sealing member's outside diameter increases slightly, creating an annular lip 27*a* that has a diameter slightly larger than the diameter of the opening 28*a*. Consequently, upon closure, the male sealing member 26*a* snaps in place into the opening 28*a*, locking the cover member 16*a* and base member 14*a* together. The male sealing member 26*a* is sufficiently long to extend through the opening 28*a* and have its open end 23 encircling the opening 9*a* and bearing against the top of the neck 10*a* of the container 10.

When the cover member 16*a* is being closed, the user must apply a small amount of additional force to the cover member 16*a* to snap it into the closed position. Concurrently, the male sealing member 26*a* is pushed into the opening 28*a* to lock the base member 14*a* and cover member 16*a* together. This structural configuration also inhibits lateral movement between the cover member 16*a* and the base member 14*a*. When the male sealing member 26*a* is inserted into the opening 28*a*, the annular lip 27*a* creates a tight seal against the opening 28*a* due to its slightly larger diameter. Thus, the container's contents are kept within the container 10 and air is kept out of the container. The mating of the male sealing member 26*a* and the opening 28*a* serves a several functions: it keeps the contents of the container 10 from either leaking out or drying out; it locks the base member 14*a* and the cover member 16*a* in the closed position; it also helps provide lateral stability so that, when the dispenser cap 12*a* is in the closed position and the user is scrubbing some item, the cover member 16*a* will stay in place, and not move, with respect to the base member 14*a* and remain connected to the base member; it relieves the stress that may be placed on the hinge 18*a* when the cap is being used as a scrubber, thereby increasing the useful life of the hinge.

The substantially circular cover top wall 60*a* has a top surface that is substantially planar. The cover top wall 60*a* is a solid piece of plastic with no openings. Extending perpendicularly away from the exterior surface of the cover top wall 60*a* is the plurality of parallel bristles 22*a*. FIG. 7 shows that the bristles 22*a* are arranged in a plurality of concentric circles centered on the center C of the cover top wall 60*a*. The bristles 22*a* are made of the same material as the cover 16*a* and are permanently attached thereto, being molded therewith. As best illustrated in FIG. 8, the cover sidewall 58*a* extends perpendicularly away from the cover top wall 60*a*, in the opposite direction as the bristles 22*a*. The cover sidewall 58*a* extends along the entire circumference of the cover top wall 60*a* and is molded as part of the same structure as the cover top wall 60*a*.

A peripheral structure at an interface between the base member 14*a* and cover member 16*a* may also be employed to act as a stop element to inhibit lateral movement of these members relative to each other and to aid in locking these members in the closed position until a manually applied force separates the base and cover members. As best shown in FIGS. 3 and 8, such a peripheral interface structure may include a matching pair comprising a ledge 46*a* on the base member 14*a* and an edge 50*a* on the cover member 16*a*. An end E1 of the cover sidewall 58*a* furthest away from the cover top wall 60*a*, along with the inside surface S1 of the sidewall 58*a*, create the edge 50*a* that when aligned with the ledge 46*a* in the base member 14*a* increases lateral stability.

Cover member 16*a* has two additional components that are both molded as part of the same structure as the cover member 16*a*. The first is the hinge 18*a*, and the second is a cover latch 82, which makes it easy for the user to transition the dispenser cap 12*a* between the open position and the closed position. The hinge 18*a* extends out from the outside surface of the cover side wall 58*a* and connects back to the outside surface of the base side wall 54*a*. The hinge 18*a* is integral with the base 14*a* and the cover 16*a*. The cover latch 82*a* is also integral with the outside surface of cover sidewall 58*a*. FIG. 5 shows that the cover latch 82 is centered on a line La that passes through the center of the hinge 18*a* and the center of the male sealing member 26*a*. The cover latch 82 includes a small protruding lip 82*a* that the user may grip with a single finger and use to lift the cover member 16*a* from the base member 14*a*.

Similar to the cover member 16*a*, the base member 14*a* has both a base top wall 56*a* and base sidewall 54*a* at a right angle with respect to each other. However, unlike cover top wall 60*a*, base top wall 56*a* has the opening 28*a* to allow the contents enclosed in container 10 to flow from the opening 9*a* in the container neck 10*a* and out the opening 28*a* when the cover member 16*a* is in the open position. The opening 28*a* can be of whatever size needed depending on the particular application. In this embodiment it is centrally located within a concentric island 29*a* (FIG. 3) on the exterior surface 52 of the base top wall 56*a*. However, whatever the diameter of opening 28*a* may be, the male sealing member 26*a* and the annular lip 27*a* have the dimensional relationship therewith as discussed above. As best shown in FIG. 5, the island 29*a* creates a slightly thicker area around the opening 28*a* to provide additional support and prolong the useful life of the opening 28*a*.

While the base sidewall 54*a* extends perpendicularly down from the outer edge of base top wall 56*a*, it does not create a flush union where they intersect. As seen in FIG. 8, the cover sidewall 58*a* extends directly off the outer edge of the cover top wall 60*a*, whereas the base sidewall 54*a* is offset inward slightly at the periphery of the base top wall 56*a*, thereby creating the ledge 46*a*. When the end E1 of the edge 50*a* of the cover sidewall 58*a* is slightly thicker than the width of the ledge 46*a*, the ledge may be used in connection with the edge to lock together the cover member 16*a* to the base member 14*a* when the dispenser cap 12*a* is in the closed position. Moreover, in the closed position, the edge 50*a* and ledge 46*a* further inhibit relative lateral movement between the base member 14*a* and the cover member 16*a*.

As best shown in FIGS. 4 and 7, within the area bounded by the base sidewall 54*a* is an additional cylindrical wall 64*a* with an internal threaded surface 66*a*. The cylindrical wall 64*a* is centrally located on the interior surface of the base top wall 56*a* and its longitudinal axis is coextensive with the axis X. The cylindrical wall 64*a* extends downward from the interior surface of the base top wall 56*a* until it is approximately ½ to ⅔ the height of the base sidewall 54*a*. The cylindrical wall 64*a* is molded as part of the same structure as the base top wall 56*a*. The threads 67*a* of the internal threaded surface 66*a* are spaced out and angled in such a manner that they match an external threaded surface of the neck 10*a* of the container 10. To further strengthen the base member 14*a* and the cylinder wall 64*a*, a plurality of support members 68*a* extend out radially from the outer surface of the cylindrical wall 64*a* to the inner surface of the base side wall 54*a*. Like the cylindrical wall 64*a*, the radial support members 68*a* are molded as part of the dispenser cap 12*a*.

FIGS. 9 Through 11

The dispenser cap 12*b* depicted in FIGS. 9 through 11 is similar to the dispenser cap 12*a* in most regards except that the cover 16*b* of dispenser cap 12*b* does not have a cover latch 82. Instead of the user applying force to a protruding cover latch 82, the user transitions the dispenser cap from the closed position (FIG. 9) to the opened position (FIG. 10) by applying a force to the portion of the cover side wall 58*b* that protrudes over an open space created by an indentation 83 in the outer surface of the base sidewall 54*b*. The indentation 83 is centered along the line Lb that extends from the center of the hinge 18*b* through center of opening 28*b*.

FIGS. 11 and 12

FIG. 11 shows the dispenser cap shown in FIG. 9 closed and lodged within a top enclosure, and inverted to show the underside of the dispenser cap. FIG. 12 shows the top enclosure with the dispenser cap lodged therein as depicted in FIG. 11 but inverted to show the exterior of the top enclosure.

FIGS. 13 and 14

FIGS. 13 and 14 show the dispenser cap 12*c* that is similar to the dispenser caps 12*a* and 12*b* in most regards except that there is a male sealing member 26*c* on a base member 14*c* rather than on its cover member 16*c*. The male sealing member 26*c* is a hollow cylinder and it extends upward from an opening 28*c* in a top wall of the base member 14*c* instead of from the dispenser cap's 12*c* cover member 16*c*. The male sealing member 26*c* in effect adds height to the opening 28*c*. An annular female sealing member 25*c* extends outward from an interior surface of the cover member's top wall 60*c*, and when in the closed position (FIG. 14), is aligned with the male sealing member 26*c*. The female sealing member 25*c* provides a cavity 25*d*. The cavity's open mouth 25*e* receives an outer end of the male sealing member 26*c* when the dispenser cap 12*c* is in the closed position. Upon mating engagement, the male sealing member 26*c* is inserted into the open mouth 25*e* to form a seal. Like the male sealing member 26*a*, the male sealing member 26*c* has a cylindrical lip 27*c* that has an outside diameter that is slightly larger than the open mouth 25*e* of the cavity 25*d*. The female sealing member 25*c* is located in the center of the interior surface of cover top wall 60*c* and its cavity 25*d* is just deep enough to allow a sealing coupling with the male sealing member 26*c* sufficient to keep the contents of the container 10 within the container 10 and also inhibiting lateral movement. The diameter of the open mouth 25*e* is slightly less than the diameter of the cylindrical lip 27*c* so the cylindrical lip 27*c* fits snugly inside the cavity and a locking engagement upon closure of the cover member 16*c*.

Top Enclosure

The top enclosure 36*a* shown in FIGS. 1 and the top enclosure 36*b* shown in FIGS. 11 and 12 are slightly different. Each is a cylindrical structure covered at one end. As shown in FIG. 14, each have a height d4 just slightly greater than or equal to the height d3 of the bristles 22*c* plus the height d2 of the cover sidewall 58*c* plus the height d1 of the base sidewall 54*c*. Each have a diameter just broad enough so that the top enclosure fits over its complementary dispenser cap but sufficiently restrictive to fit snug enough so that it will not accidentally slip off. There is also a slot 85 on the outside surface 35*b* of the cap enclosure 36*b* to allow the cap to fit over the protruding hinge 18*b* of the dispenser cap 12*b*. The top enclosure 36*a* as shown in FIG. 1 has in addition to the slot 85 a second slot 85*a*. The second slot 85*a* is needed because the dispenser cap 12*a* that has the protruding cover latch 82. Consequently, the second slot 85*a* accommodates the protruding cover latch 82 when attached to the dispenser cap 12*a*.

The top enclosure 36*a* may also be fastened in a manner to prevent inadvertent removal. This keeps the dispenser cap of this invention closed to prevent spillage of the contents of the container 10. For example, the top enclosure 36*a* may be sized so that it must be force fitted onto a dispenser cap of this invention. Alternately, or in addition to, a shrink-wrap SW may be applied to the top enclosure 36*a* as illustrated in FIG. 1, which shows the shrink-wrap removed. The top enclosure 36*a* optionally may have an exposed abrasive surface F that functions as a file. This surface may be formed in the top enclosure 36*a* during a molding manufacturing process, or it may be a metal file or sand paper bonded to its top.

FIGS. 15 Through 18

The dispenser cap of this invention may come in many different shapes depending on the purpose for which it is needed. FIGS. 15 through 18 illustrate additional possible shapes of the dispenser caps. The oval dispenser cap 12*d*, the hexagon dispenser cap 12*e*, and the triangle dispenser cap 12*f* are all similar to the previous dispenser caps 12*a*-12*c* in that the bristles 22*d*-22*f* respectively, are arranged in a plurality of concentric circles centered around the center C of the respective cover top wall 60*d*-60*f*. In contrast, a square dispenser cap 12*g* has its bristles arranged in a plurality of equal length parallel rows covering the top of the cover top wall 60*g*. The oval dispenser cap 12*d*, triangle dispenser cap 12*f* and square dispenser cap 12*g* all utilize cover latches 82*d*, 82*f*, and 82*g* respectively, as the means for allowing the user to put the dispenser cap in the open position. Additionally, the oval dispenser cap 12*d* has its hinge 18*d* and cover latch 82*d* lined up along line Ld which pass through the major axis of the oval. The triangle dispenser cap 12*f* has its hinge 18*f* centered along one of the flat sides of the triangle with the cover latch 82*f* being centered on the point directly opposite the flat side where hinge 18*f* is located. The square dispenser cap 12*g* has its cover latch 82*g* and hinge 18*g* centered on two opposite sides of the square. Because concentric circles would not be able to fill the entire area of the oval or the triangle, the bristles 22*d* and 22*f* have portions of concentric circles to fill the empty regions. The portions of the concentric circles are at the two opposite ends of the oval dispenser cap 12*d*, along the major axis, and in the three points of the triangle of the triangle dispenser cap 12*f*. The hexagonal dispenser cap 12*e* utilizes an indentation in the base member, similar to dispenser cap 12*b* to allow the user to place the hexagonal dispenser cap 12*e* in the open position.

FIGS. 19 Through 22

The dispenser cap of this invention is molded using conventional molding techniques. As shown in phantom lines in FIG. 19, a mold is used having a pair of mold elements M1 and M2 including aligned cavities C1 and C2 connected by a hinge cavity H1. The base member, cover member and hinge of the different embodiments of this invention are formed within these cavities C1, C2 and H1, respectively. These cavities C1, C2 and H1 are oriented during molding so that the base member and cover member of the dispenser cap being formed are in an open position and substantially aligned with each other and are in the same plane as the hinge connecting these members. Closing wheels 90 may be used in the production of the dispenser caps of this invention. The purpose of the closing wheels 90 is to close the dispenser cap as it is being ejected from the mold elements M1 and M2.

Assuming the dispenser cap 12*a* is being molded, base member 14*a* and cover member 16*a* are oriented in the mold in the second or open position so the exterior surface S2 of the base member top wall 56*a* and the interior surface 15*a* of the cover member top wall 60*a* face in the same general direction and are substantially aligned with the hinge 18*a*. The closing wheels 90 first approach the opened dispenser cap 12*a* from the cover latch 82*a* end of the dispenser cap 12*a* as it is being ejected. The closing wheels 90 are spaced far enough apart so that the entire width of the bristles 22*a* fits between them, but the closing wheels 90 are close enough together that they are able to ride along the edge E2 of the cover member 16*a* that extends beyond the area covered by the bristles 22*a*. The closing wheels 90 then proceed along the edge E2 of the cover 16*a* that extends beyond the bristles 22*a* moving away from the cover latch 82*a* and towards the hinge 18*a*. At some point after the closing wheels 90 are past the center of the cover 16*a* but before they reach the hinge 18*a*, the cover 16*a* will pass from angling away from the base 14*a* to angling towards the base 14*a*. At this point the closing wheels 90 will continue moving in the same direction but now will be traveling along the cover 16*a* away from the hinge 18*a* and towards the cover latch 82*a*. As the closing wheels 90 pass over the area just before the cover latch 82*a*, the cover member 16*a* will be closed down on the base member 14*a* and the dispenser cap 12*a* will be in the closed position, sealed and ready for shipment.

FIGS. 23 Through 28

Figure 27:
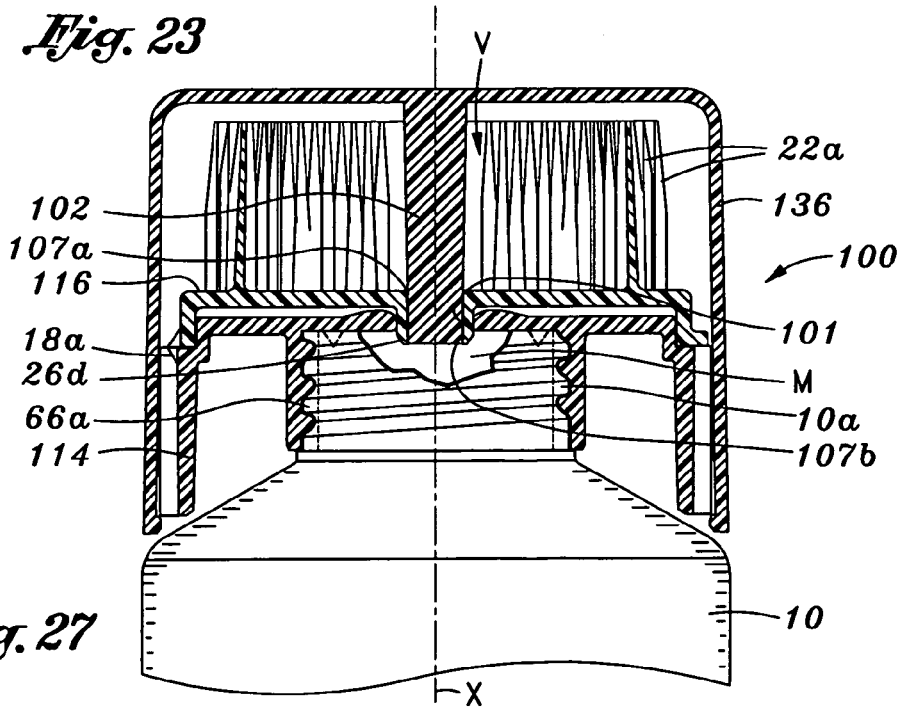
FIG. 27 is cross-sectional view taken along line 27-27 of FIG. 24, showing the top of the container with the dispenser cap attached and in a completely closed position along with the top enclosure attached and entirely covering the dispenser cap.
Figure 25:
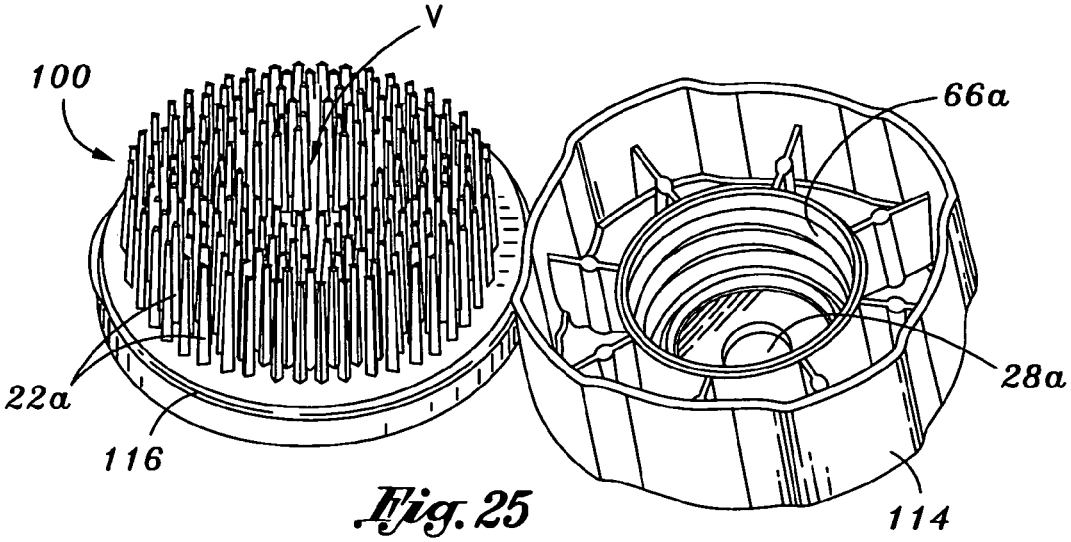
FIG. 25 is a perspective view of the dispenser cap shown in FIG. 23 in a completely open position showing the underside of the base member and topside of the cover member.

FIGS. 23 through 28 show the dispenser cap 100 that employs the opening 101 passing through the cap's cover member 116 as well as the opening 28*a* passing through cap's base member 114. As with the other embodiments, the dispenser cap 100 uses a "living" hinge 18*a* to connect the base member 114 to the cover member 116. The dispenser cap 100 is a single, integral, unitary structure molded in essentially the same manner as discussed above in connection with the other embodiments. It comprises the cover member 116 and attached bristles 22*a*, the base member 114, and the hinge 18*a*. As shown in FIG. 27, the dispenser cap 100 may be attached to the container 10 by mating an internal threaded surface 66*a* located within the base member 114 to a matching threaded container neck 10*a* having an open mouth M. With the cap 100 in the closed position and connected to the container 10 as shown in FIG. 27, a longitudinal centerline X of the cap 100 is aligned with and extends through the centers of the openings 101 and 28*a* and a male guide member 26*d*.

The opening 101 may be circular and centrally located in the cover member 116 and aligned with the circular opening 28*a* in the base member 114. There is a void V in the bristles 22*a* that surround the circular opening 101 of the cover member 116. This void V may be circular or another shape. The opening 101 in the cover member 114 and the circular opening 28*a* in the base member 114 are in communication with the container 10 through the open mouth M (FIG. 27) in the end of the container.

In this embodiment, a detachable top enclosure 136 covers the closed cap 100 and is removed when fluid is to be dispensed. With the top enclosure 136 removed and the cover member 116 in its closed position (FIG. 23), the contents of the container 10 may be expelled from the container 10 through the closed dispenser cap 100 by exiting though the mouth M, and then through the opening 28*a* and the opening 101 to fill the void V. The contents may also be expelled when the cover member 116 is in an open position (FIG. 26) directly through the openings 28*a*.

Figure 23:
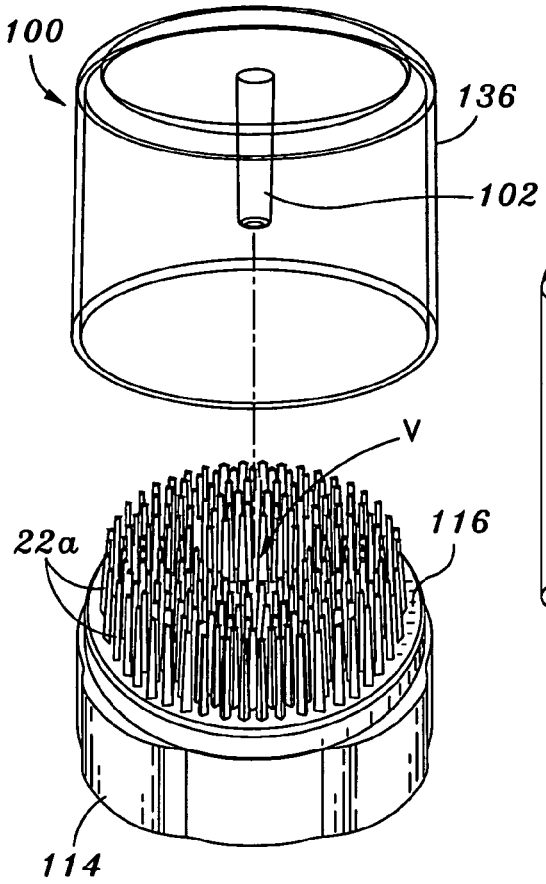
FIG. 23 is a perspective view of another embodiment of the dispenser cap of this invention in the closed position with a top enclosure detached.
Figure 24:
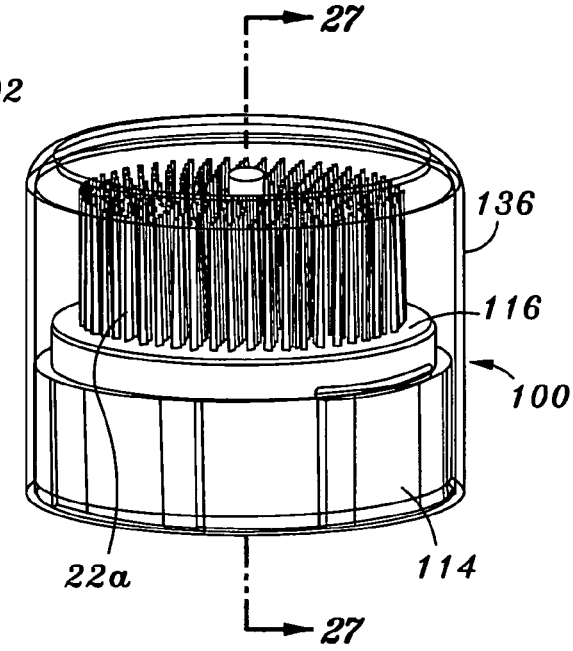
FIG. 24 is a side view of a dispenser cap shown in FIG. 23 with the dispenser cap in a completely closed position with a top enclosure attached and entirely covering the dispenser cap.

The top enclosure 136 shown in FIGS. 23, 24, and 27 is different from the top enclosure depicted in the other embodiments, employing an elongated pin element 102, which is a solid structure, and in this embodiment, cylindrical in configuration. This type of top enclosure 136 is used in connection with the invention disclosed in U.S. patent application Ser. No. 11/155,015, filed Jun. 16, 2005, entitled "Twist-Open Dispenser With Applicator & method Of Applying Skin Care Products & method Of Merchandising Paint." When the cap 100 is in the closed position shown in FIG. 27 and the top enclosure 136 is attached to the cap, the pin element 102 at least partially extends through the cover member 116 and into the base member 114.

Figure 26:
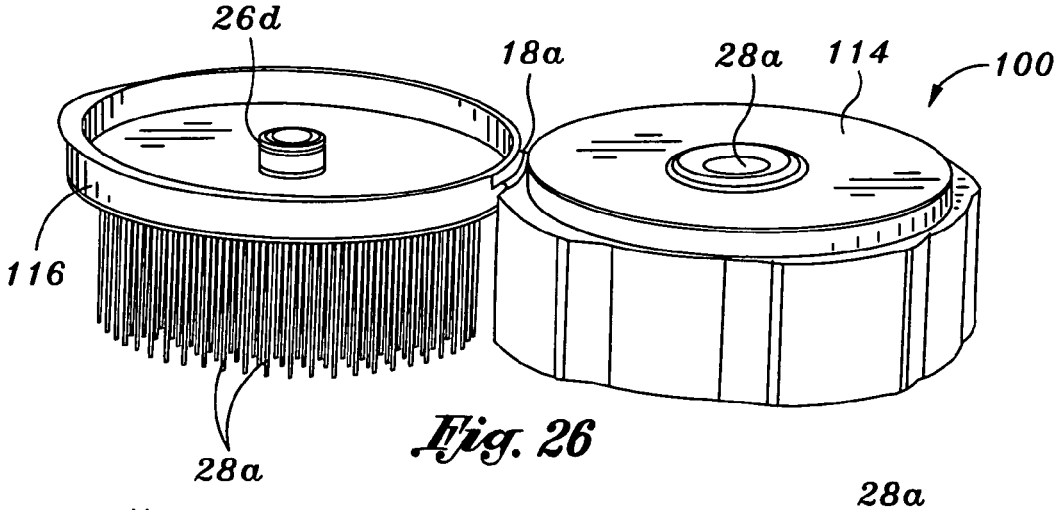
FIG. 26 is a perspective view of the dispenser cap shown in FIG. 23 in a completely open position.
Figure 28:
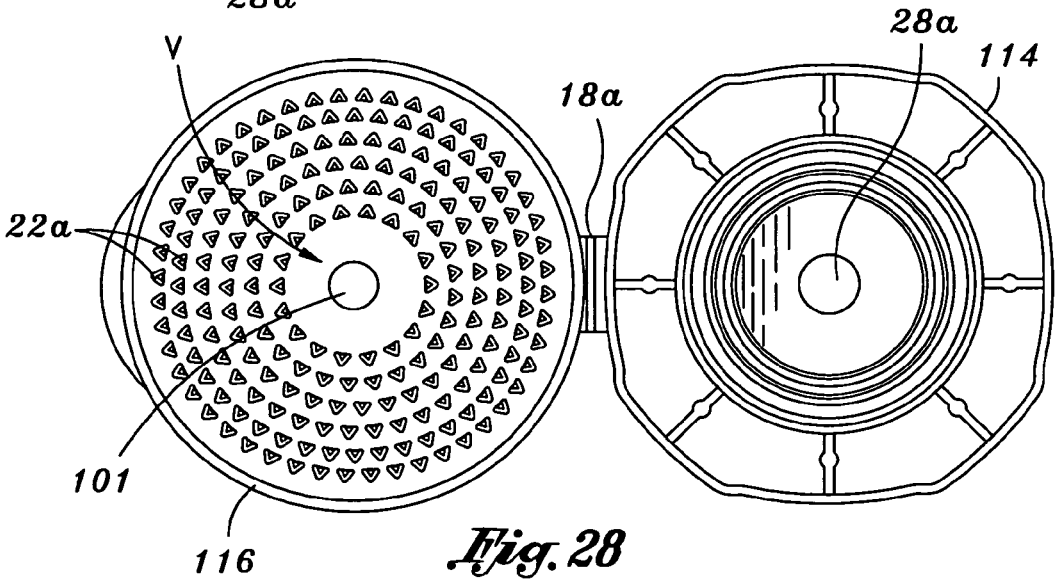
FIG. 28 is a plan view of the dispenser cap shown in FIG. 23 in a completely open position showing the interior surface of the top wall of the base member and the exterior surface of the top wall of the cover member.

As best illustrated in FIGS. 26 and 27, the male guide member 26*d* is different than the male guide members in the other embodiments. It has been modified to provide a passageway there through, enabling the contents of the container 10 to flow through it when the cap 100 is closed and the top enclosure 136 is removed. In contrast to the male guide member 26*a* for example, the male guide member 26*d* is a tubular structure that is open at its opposed ends 107*a* and 107*b* as depicted in FIG. 27. The opening 101 is at an outer end 107*a* of the male guide member 26*d* so that the container's contents upon being expelled flow through the male guide member between its open inner end 107*b* and out the outer end 107*a*. As with the other embodiments, the male guide member 26*d* fits snug into the opening 28*a* and is sufficiently long to extend through the opening 28*a* when the cap 100 closed. With the cap 100 closed and the top enclosure 136 attached, the pin element 102 passes through the void V in the bristles 22*a*, through the opening 101 in the cover member 116 and into the male guide member 26*d* to plug it so that the contents of the container cannot escape through the passageway in the male guide member 26*d*, thus preventing the contents from leaking out of, or being expelled from, the container 10.

Contents of the container 10 may be expelled with the top enclosure 136 removed and the cover member 116 either opened or closed. Once the user is finished dispensing at least a portion of the container's contents, he or she may then close the cover member 116 and use the bristles 22*a* to scrub a surface, for example. When finished scrubbing, the top enclosure 136 is replaced on the closed dispenser cap 100. The top enclosure 136 may be made of a transparent material, for example, so that the bristles may be seen when the top enclosure is in place as shown in FIG. 24. The top enclosure 136 enables the bristles 22*a* to be covered and protected when not in use while sealing the opening 101 in the cover member 116 and the opening 28*a* in base member 114.

When the cover member 116 is being closed, the user must apply a small amount of additional force to the cover member to snap it into the closed position. Concurrently, the male guide member 26*d* is pushed into the opening 28*a* to lock the base member 114 and cover member 114 together. This structural configuration also inhibits lateral movement between the cover member 116 and the base member 114.

Like the other embodiments, the top enclosure 136 may have an external abrasive surface, and the dispenser cap 100 may include a stop element that inhibits lateral movement of the base member 116 and cover member 114 relative to each other when the base member and cover member when the cap is closed and a lock element that locks these members closed until a manually applied force separates them.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. A cap for a container comprising a base member and a cover member attached to the base member by a hinge element to enable the base member and cover member to move between a first position where the cover member covers the base member and a second position where the cover member uncovers the base member, said base member including a base member side wall and a base member top wall substantially at a right angle to the base member side wall, said base member top wall having an opening therein and a ledge along at least a portion of a perimeter of said base member top wall, said base member top wall having an interior surface with a coupling member adapted to detachably connect the cap to a container, said cover member including a cover member side wall and a cover member top wall substantially at a right angle to the cover member side wall, said cover member top wall having an exterior surface with a pluralily of bristle elements projecting outward therefrom and an interior surface with a sealing member that seals said opening when the cover member and base member are in the first position, said base member, cover member, and hinge element being an integral, unitary structure and where the coupling member comprises a cylindrical wall with an internal threaded surface and the base member includes a cylindrical wall with an inside surface and a plurality of radial support members extending between said inside surface and an outside surface of the coupling member cylindrical wall.

2. A cap for a container comprising a base member with an opening therein and a coupling member adapt to be detachably connected to an open dispensing end of the container, said coupling member comprising a cylindrical wall with an internal threaded surface and the base member includes a cylindrical wall with an inside surface and a plurality of radial support members extending between said inside surface and an outside surface of the coupling member cylindrical wall, a cover member attached to the base member by a hinge element to enable the base member and cover member to move between a first position where the cover member covers the base member and a second position where the cover member uncovers the base member, said cover member having an exterior surface with a plurality of bristle elements projecting outward therefrom and substantially parallel to each other, and a sealing member that seals the opening when the cover member and base member are in the first position, said base member, cover member, and hinge element being an integral, unitary structure molded from a plastic material, said cap being formed in a mold in which the base member and cover member are in the second position and substantially aligned in the same plane along with said hinge member.

3. A cap for a container comprising a base member with an opening therein and a coupling member adapted to detachably connect the cap to a container, a cover member attached to the base member by a hinge element to enable the base member and cover member to move between a first position where the cover member covers the base member and a second position where the cover member uncovers the base member, said cover member having an exterior surface with a plurality of bristle elements projecting outward therefrom and an interior surface having a sealing member thereon that seals the opening when the cover member and base member are in the first position, said base member, cover member, and hinge element being an integral, unitary structure, said coupling member comprising a cylindrical wall with an internal threaded surface and said base member including a cylindrical wall with an inside surface and a plurality of radial support members extending between said inside surface and an outside surface of the coupling member cylindrical wall.

* * * * *